US006061842A

United States Patent [19]

Randolph, Sr.

[11] Patent Number: 6,061,842

[45] Date of Patent: May 16, 2000

[54] HAND SUPPORT APPARATUS OVER A COMMODE OR URINAL

[76] Inventor: James E. Randolph, Sr., 216 Lawton Cir., Wilmington, N.C. 28412

[21] Appl. No.: 09/234,189

[22] Filed: Jan. 20, 1999

[51] Int. Cl.[7] ..... E03D 11/00

[52] U.S. Cl. ..... 4/254; 4/661; 4/301

[58] Field of Search ..... 4/254, 301, 661, 4/576.1, 577.1, 611, 310, 449, 465, 478; 248/218.4, 219.2, 220.21, 221.11, 222.12, 224.7, 224.8, 905, 297.31, 298.1, 411, 413

[56] References Cited

U.S. PATENT DOCUMENTS

| | | | |
|---|---|---|---|
| 3,713,180 | 1/1973 | Martin . | |
| 3,977,028 | 8/1976 | Chang . | |
| 4,012,797 | 3/1977 | Kristofferson . | |
| 4,343,052 | 8/1982 | Guenther | 4/254 |
| 5,228,151 | 7/1993 | Livingston-Capoano . | |
| 5,329,645 | 7/1994 | Fossum et al. | 4/254 |
| 5,340,070 | 8/1994 | Soma . | |
| 5,647,072 | 7/1997 | Shaffer et al. . | |

FOREIGN PATENT DOCUMENTS

| | | | |
|---|---|---|---|
| 571802 | 1/1958 | Italy | 4/254 |

*Primary Examiner*—Henry J. Recla
*Assistant Examiner*—Huyen Le
*Attorney, Agent, or Firm*—Charles Edison Smith

[57] ABSTRACT

The hand support device comprises a structure mounted to a bathroom wall over the commode or urinal. The support device comprises a generally flat base portion and a horizontally extending adjustable post mechanism attached to the base portion. Adjustable post mechanism is mounted between a palm contact substrate and a brace. The post mechanism includes a hollow horizontal tube having a horizontal rod adjustably disposed within the tube. The tube is formed with a plurality of apertures of a diameter for selectively receiving a spring-loaded pin formed on a surface of the rod to establish a plurality of hand support positions. One end of the adjustment rod contains a ball bearing embedded within a brace partially in the base plate thereby allowing the post to pivot about a vertical and horizontal axis.

35 Claims, 3 Drawing Sheets

HAND SUPPORT APPARATUS OVER A COMMODE OR URINAL

BACKGROUND OF THE INVENTION

1. Field of the Invention

This invention relates generally to bathroom support devices, and, more particularly to a bathroom hand support device permitting a male to rest against the device while standing and urinating.

2. Description of the Related Art

When using the bathroom to urinate, it is often noticed that handprints are on the bathroom wall over the urinal or commode. It is apparent that these handprints are the result of individuals, primarily men with dirt, grease, paint or other sticky substances leaning forward and extending one arm forward so that the extended hand rests in a position on the wall to provide support. The need for some men to lean against the wall when urinating can be attributed to a variety of reasons such as for ones convenience, physical condition, or simply because of habit. As a result of this practice by some men, the bathroom wall can become soiled with dirty handprints, worn and even marred or disfigured in a common strike area over the commode or urinal.

Although various types of bathroom support devices have been proposed generally for the safety and convenience of the individual, such devices are not sufficient to guard against the tell-tell dirty handprint and soiled bathroom wall problem. For example, the bathroom safety and convenience devices disclosed in U.S. Pat. No. 4,012,797 by Kristoffersen ('797); U.S. Pat. No. 3,977,028 by Chang ('028); U.S. Pat. No. 5,647,072 by Shaffer et al ('072); U.S. Pat. No. 5,340,070 by Soma ('070), U.S. Pat. No. 5,228,151 by Livingston-Capoano ('151); and U.S. Pat. No. 3,713,180 by Martin ('180) are not adapted to support the hand of a commode user and do not address the need to protect against damage to the bathroom wall in the area above the commode. The device of the '797 patent shows a commode fixture with adjacent wall mounted handgrips located on both sides of the commode for hand support when facing towards the commode fixtures. However, the handgrips disclosed in the '797 patent are not at the proper height above the commode to permit use thereof by men when in the erect or standing position. The device of the '028 patent shows a movable backrest supported on a wall behind a commode. This device is movable to a position over the raised commode lid for support of the back of a user of the commode while sitting. Accordingly, the disclosure in the '028 patent has no application concerning the need to guard against the adverse effects caused by hands contacting the bathroom wall repetitively over a period of time. The devices disclosed in the '072, '070, '151 and '180 patents show various types of structure for supporting the foot and leg of a bather or when shaving the leg, or to facilitate washing and drying of the feet and legs. Thus, the disclosures in these prior art patents are also not satisfactory structures for addressing the practice on men leaning against the bathroom wall while urinating.

This invention is advantageous in that it provides a need for convenient and stable hand support means for use by a male user of a urinal or commode.

Another advantage of the invention is that it provides an apparatus made of a sufficiently rigid material that will give men a place to rest a hand in a target strike area above the commode.

A further advantage is derived by providing a hand element in the bathroom that can be adjusted and pivoted to a plurality of positions to accommodate men of different heights that require a stable and convenient device to lean against while urinating.

The invention is also advantageous in that it provides a hand support apparatus that can be pivoted about a vertical and horizontal axis and also provide stability and convenience to men while urinating thereby preventing harm or disfigurement to the bathroom wall.

Still another advantage of the invention is in providing a convenient and stable hand support means equipped with a sanitary towel dispenser for use by multiple users of a urinal or commode.

Additional advantages and features of the invention will become apparent from the description, which follows, and may be realized by means of the instrumentalities and combinations particularly pointed out in the appended claims.

SUMMARY OF THE INVENTION

According to a preferred embodiment of the invention, a support device having a hand contact prop firmly affixed to a wall and an adjustable post pivotally positioned above a commode or urinal are provided. Hand support components include a base plate, an adjustable post mechanism mounted between a palm contact form and a brace, and a sanitary towel dispenser mounted to dispense towels. The user may optimally select a preferred hand rest position by manipulating an adjustment rod that is in sliding engagement with a hollow tube so that a spring-loaded pin carried by the rod is aligned with one of the openings in the tube. This pin thus uniquely permits the adjustment rod to be slideably arranged within the tube in a plurality of positions. One end of the adjustment rod contains a ball embedded within the sub-base and partially in the base plate, which permits the rod to pivot in a unique way about a vertical and horizontal axis.

Other features and advantages of the invention will become apparent upon making reference to the specification, claims and drawings to follow.

DESCRIPTION OF THE PREFERRED EMBODIMENTS

Figure 1:
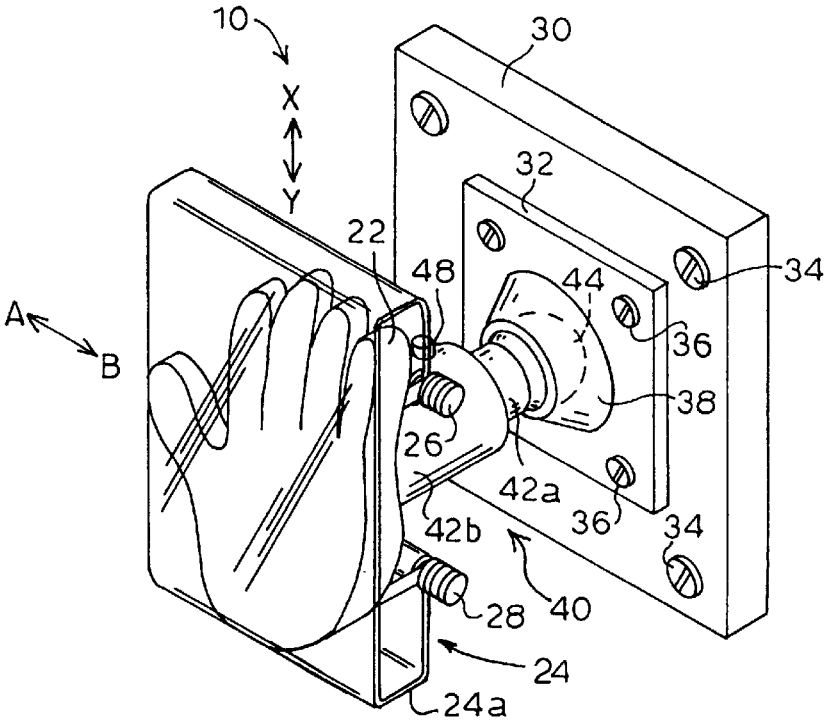
FIG. 1 is a perspective view of a hand support apparatus according to a first embodiment of the present invention, showing a condition wherein an adjustable post is extended to the long position from a bathroom wall.
Figure 2:
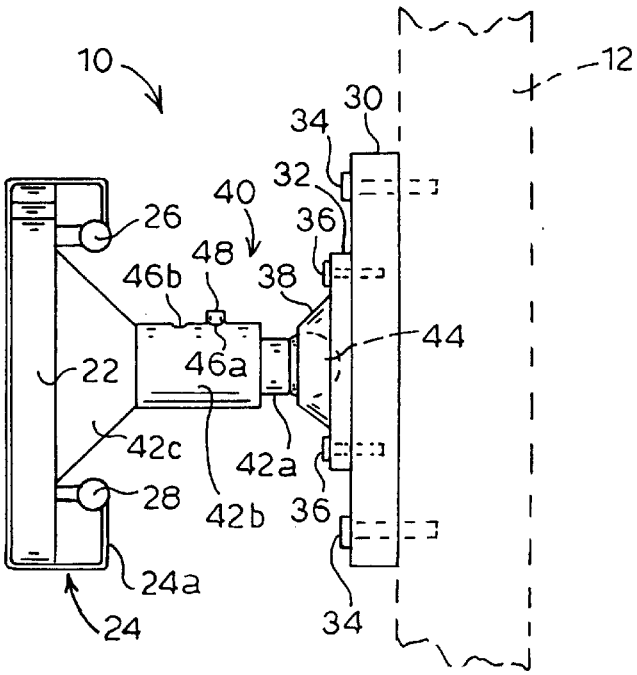
FIG. 2 is a right side elevation view of Hand support apparatus of the first embodiment of the invention shown in FIG. 1.

FIG. 1 and FIG. 2 show a preferred embodiment of Hand rest or support apparatus 10 in accordance with the present invention. FIG. 1 shows a perspective view of Hand support apparatus 10 and FIG. 2 shows a right side elevation view of Hand support apparatus 10. Hand support apparatus 10 comprises a generally flat base plate 30, an adjustable post mechanism 40, a hand contact substrate or form 22 and a sanitary towel dispenser 24. Base plate 30 is firmly affixed to a bathroom wall 12 by fasteners 34 in a position above a commode, commode or urinal (not shown). Adjustable post mechanism 40 is horizontally mounted between hand contact form 22 and a brace 32. Brace 32 is fixedly connected to a surface of plate 30 by fasteners, which may, for example, be screws, rivets or bolts 36. Brace 32 serves as a sub-base for base plate 30 and is provided with a collar 38 integrally formed on a surface of brace 32. Collar 38 essentially serves as a pedestal for adjustable post mechanism 40.

As illustrated in FIGS. 1 and 2, the base plate 30 is of a generally rectangular shape, and is formed of a hard, rigid material. Preferably, the base plate 30 is made of a metal material and, optimally, is anchored to the wall 12 with four bolts 36, one at each corner of base plate 30. Similarly, brace 32 is of a rectangular shape, and is made of a rigid metal material. Hand contact form 22 is in the shape of an open or extended hand, and is constructed of a rigid material, such as iron, hard wood, metal or the like.

Still referring to FIGS. 1 and 2, adjustable post mechanism 40 comprises adjustment rod 42*a*, a hollow tube 42*b* and connecting flange 42*c*. Flange 42*c* is generally cone-shaped and is firmly fixed to the back surface of hand contact form 22.

One end of adjustment rod 42*a* carries a friction-reducing ball bearing 44 that is housed and retained by collar 38. Ball bearing 44 extends through an opening in brace 32 and into a recess in the surface of base plate 30. The outside diameter of adjustment rod 42*a* uniquely corresponds with the inside diameter of hollow tube 42*b*.

Referring still to FIGS. 1 and 2, tube 42*b* is provided with a "long position", aperture or opening 46*a* and a "short position" opening 46*b* formed in a surface thereof. "Long position" opening 46*a* and "short position" opening 46*b* are of a diameter sufficient for receiving a spring-loaded pin 48 formed in a surface of adjustment rod 42*a*. Pin 48 can be manually depressed by the user and selectively moved and released thereby allowing pin 48 to extend vertically through either opening 46*a* or open ing 46*b*. Whenever pin 48 is aligned to extend through the "long position" opening 46*a*, adjustable post mechanism 40 is in the "long position." When adjustable post mechanism 40 is in the "long position," the distance of hand contact form 22 from wall 12 is in the range of more than 6.25 to about 8.25 inches measured in a horizontal plane. Whenever pin 48 is aligned to extend through "short position" opening 46*b*, adjustable post mechanism 40 is in the short position. When adjustable post mechanism 40 is in the "short position," this means that the distance of hand contact form 22 from wall 12 is in the range of about 4.25 to not more than 6.25 inches measured in a horizontal plane. The user may optimally select a preferred hand rest position between the "long position" and the "short position" by manipulating the adjustment rod 42*a* that is in sliding engagement with the opening of hollow tube 42*b*. For example, spring-loaded pin 48 carried by the rod 42*a* is selectively aligned with one of the desired openings 46*a* or 46*b* in tube 42*b*. Thus, pin 48 uniquely allows the adjustment rod 42*a* to be slideably arranged within tube 42*b* in a plurality of positions. Also, ball bearing 44 formed in adjustment rod 42*a* permits adjustable post mechanism 40 optimally to pivot in a unique way about a vertical and horizontal axis. For example, if desired, adjustable post mechanism 40 may be pivoted in a manner indicated by the arrow in a horizontal direction where: A=left and B=right. In addition, adjustable post mechanism 40 can be pivoted in a manner indicated by the arrow in a vertical direction where: X=up and Y=down.

For sanitary protection, a towel dispenser 24 permits a transparent or clear roll of paper towel 24*a* to be continuously dispensed from a supply roller 26 by manually turning the knurl knob formed on the ends of a take-up roller 28. Rollers 26 and 28 are vertically spaced from each other so that a length of paper towel 24*a* extending from the clean towel supply roller 26 to used towel take-up roller 28 and is entrained over hand contact form 22. To permit the withdrawal and advancement of a clean towel, the user must turn supply roller 26. A knurl knob (not shown) is included on the ends of supply roller 26 for manually drawing any slack towel back onto supply roller 26 after advancement of take-up roller 28.

Figure 3:
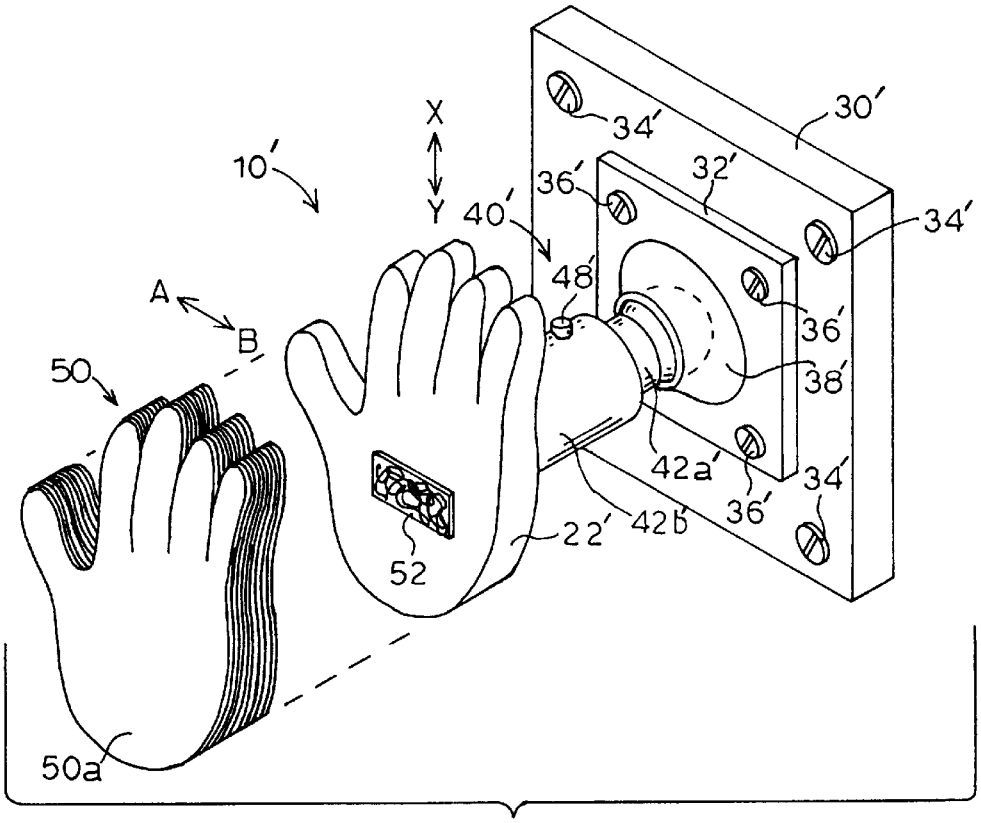
FIG. 3 is a perspective view similar to FIG. 1 but showing a second embodiment of the invention and a portion thereof in exploded position for illustrative purposes.
Figure 4:
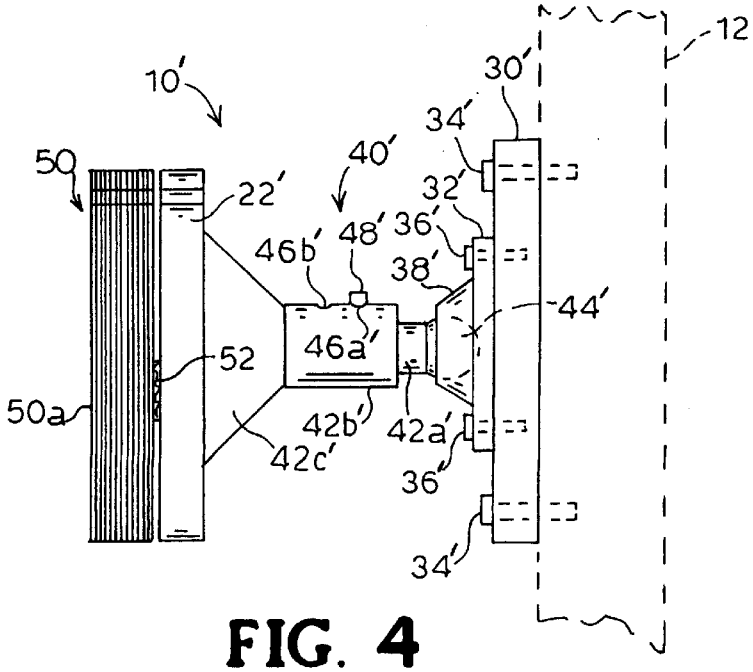
FIG. 4 is a right side elevation view similar to FIG. 2, but showing the second embodiment of invention illustrated in FIG. 3.

Referring now to FIGS. 3 and 4, there is shown a second embodiment of hand rest or support apparatus 10' in accordance with the present invention. FIG. 3 shows a perspective view of hand support apparatus 10' and FIG. 4 shows a right side elevation view of hand support apparatus 10'. Some of the elements enumerated in the second embodiment in FIGS. 3 and 4 are common to numbered elements shown in the first embodiment, and therefore are identical. Hence, hand support apparatus 10' in FIGS. 3 and 4 comprises a generally flat base plate 30', an adjustable post mechanism 40', a hand contact substrate or form 22' and a towel dispenser 50. Base plate 30' is firmly affixed to a bathroom wall 12' by fasteners 34' in a position above a commode or urinal (not shown). Adjustable post mechanism 40' is horizontally mounted between hand contact form 22' and a brace 32'. Brace 32' is fixedly connected to a surface of plate 30' by fasteners, which may, for example, be screws, rivets or bolts 36'. Brace 32' serves as a sub-base for base plate 30' and is provided with a collar 38' integrally formed on a surface of brace 32'. Collar 38' essentially serves as a pedestal for adjustable post mechanism 40' and housing for ball bearing 44'.

As was described in regard to the first embodiment, adjustable post mechanism 40' comprises an adjustment rod 42*a*', a hollow tube 42*b*' and connecting flange 42*c*'. The cone-shaped flange 42*c*' is firmly fixed to the back surface of hand contact form 22', whereas the end of adjustment rod 42*a*' that contains ball bearing 44' is housed and retained by collar 38'. Adjustment rod 42*a*' is slideably disposed within hollow tube 42*b*' and, at the option of the user, rod 42*a*' is adjustable to either a "long position" or "short position."

Referring still to FIGS. 3 and 4, for sanitary protection, hand support structure apparatus 10' includes a paper towel pad 50*a* containing a number of tear-off paper towels shaped in the form of an open or extended hand to match the shape of contact form 22'. The front surface of form 22' is provided with a pad connector 52. which may, for example, be a Velcro® strip. Pad connector 52 is designed to fixedly connect with a mating member on the back of pad 50*a* (not show) to facilitate replenishing and coupling towel pad 52*a* to form 22'. Whenever a paper towel becomes dirty from use, the dirty towel is simply torn away from pad 50*a* and a clean towel then becomes available at the front of pad 50*a* for use thereof.

Still referring to FIGS. 3 and 4, in the same manner as described in connection with the first embodiment, if desired, adjustable post mechanism 40' may be pivoted in a manner indicated by the arrows. Thus, adjustable post mechanism 40' can be pivoted in a horizontal direction (where A=left and B=right) and in vertical direction (where X=up and Y=down).

Figure 5:
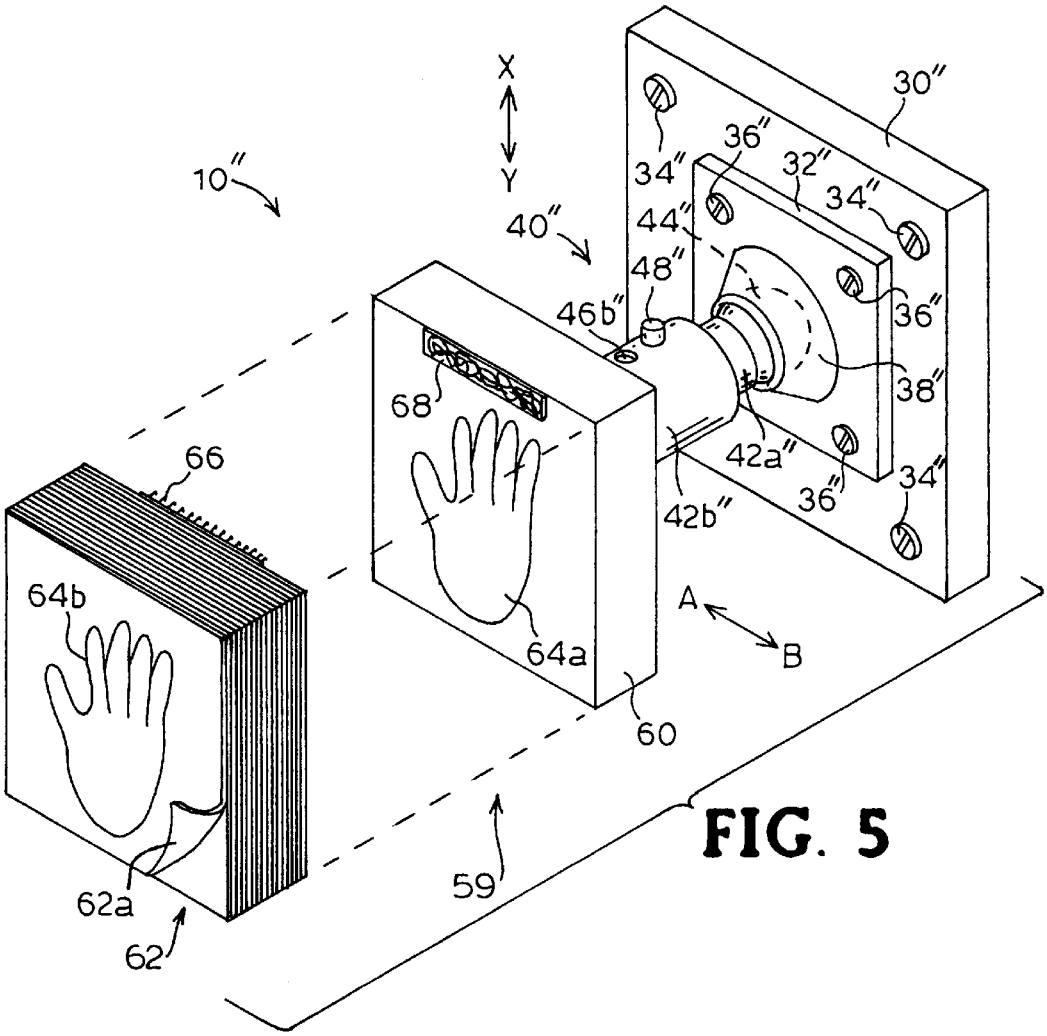
FIG. 5 is a perspective view similar to FIG. 1 but showing a third embodiment of the invention and a portion thereof in exploded position for illustrative purposes.
Figure 6:
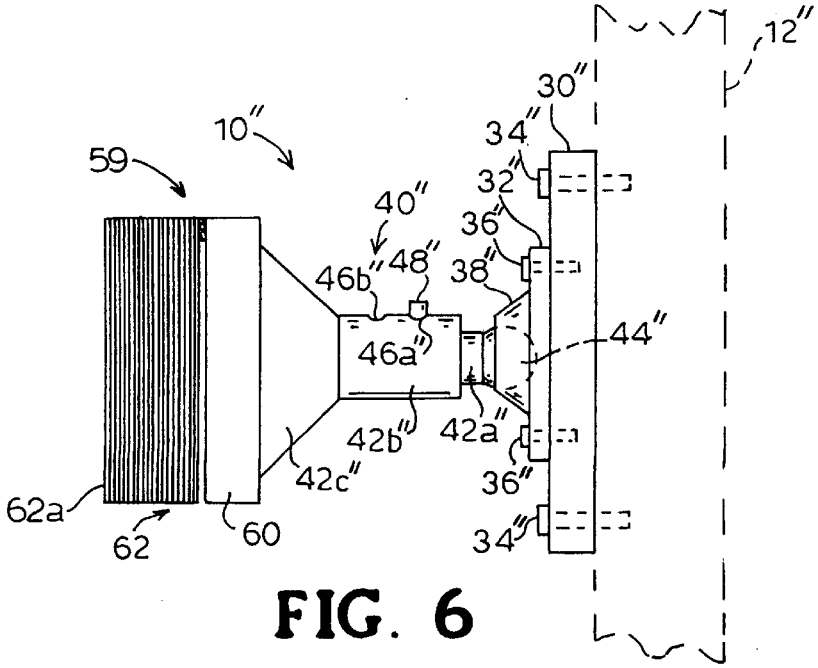
FIG. 6 is a right side elevationn view similar to FIG. 2, but showing the third embodiment of Hand support apparatus of the invention illustrated in FIG. 5.

Referring now to FIGS. 5 and 6, there is shown still a third embodiment of the hand rest or support apparatus 10" in accordance with the present invention. FIG. 5 shows a perspective view of hand support apparatus 10" and FIG. 6 shows a right side elevation view of hand support apparatus 10". Some of the elements enumerated in the third embodiment in FIGS. 5 and 6 are common to numbered elements shown in the first embodiment and second embodiment, and therefore are identical. Therefore, common components for hand support structure 10", namely, base plate 30", fasteners 34", adjustable post mechanism 40", adjustment rod 42*a*", hollow tube 42*b*", flange 42*c*", ball bearing 44", brace 32", bolts 36", collar 38" and pin 48" are as was described in connection with FIGS. 1 through 4.

Referring still to FIGS. 5 and 6, hand support structure 10" includes a modified paper towel dispenser 59. In this third embodiment, paper towel dispenser 59 includes a hand support bar 60. Hand support bar 60 is of a generally rectangular shape to match the shape of the pad 62 provided with tear-off paper tissues 62*a*. The front surface of support bar 60 contains an etched hand image 64*a* and is provided with a Velcro strip 68. Strip 68 is designed to fixedly connect with a mating member 66 at the back of pad 62 to facilitate replenishing and coupling pad 62 provided with paper tissues 62 to support bar 60. Paper tissues 62 may be designed with a handprint impression 64*b*. Whenever a tissue 62*a* becomes dirty from use, dirty tissue 62*a* is simply torn away from tissue pad 62 and a clean paper tissue then becomes available at the front of tissue pad 62 for use thereof.

Still referring to FIGS. 5 and 6, in the same manner as described in connection with the first embodiment and the second embodiment, if desired, adjustable post mechanism 40' may be pivoted in a manner indicated by the arrows to a desired position. As indicated by the arrows, adjustable post mechanism 40" can be pivoted in both a horizontal direction (where A=left and B=right) and in vertical direction (where X=up and Y=down).

While the invention has been particularly shown and described with reference to certain preferred embodiments, it will be understood by those skilled in the art that various alterations and modifications in form and detail may be made therein. Accordingly, it is intended that the following claims cover all such alterations and modifications as may fall within the true spirit and scope of the invention.

What is claimed is:

1. Hand support apparatus for resting a user's hand above a bathroom commode or urinal comprising:

(a) a base plate adapted to be mounted to a bathroom wall;

(b) a longitudinally adjustable post mechanism pivotally connected at one end to the base; and (c) a hand contact form which is fixedly connected to another end of said post mechanism.

2. The apparatus according to claim 1 wherein said adjustable post mechanism comprises an adjustment rod slideably disposed in a tube and is secured horizontally in one of a plurality of positions.

3. The apparatus according to claim 2 wherein said base is attached to a bathroom wall by a plurality of fasteners.

4. The apparatus according to claim 3 wherein said rod is provided with a spring-loaded pin extending upward vertically for alignment with and through pre-selected openings in said tube.

5. The apparatus according to claim 4 wherein a brace is fixedly connected to a surface of said base plate by a plurality of fasteners.

6. The apparatus according to claim 5 wherein said brace comprises a collar integrally formed on a surface of said brace.

7. The apparatus according to claim 6 wherein said brace functions as a pedestal for said adjustable post mechanism.

8. The apparatus according to claim 7 wherein said base plate is formed of a hard rigid material.

9. The apparatus according to claim 8 wherein said brace is formed of a rigid material.

10. The apparatus according to claim 9 wherein said hand contact form is in the shape of an open or extended hand and is constructed of a rigid material.

11. The apparatus according to claim 6 wherein said adjustable post mechanism comprises an adjustment rod and a hollow tube coupled to a connecting flange.

12. The apparatus according to claim 11 wherein said flange is generally cone-shaped and is firmly fixed to a back surface of said hand contact form.

13. The apparatus according to claim 12 wherein said adjustment rod has a ball bearing fixed on one end thereof and is housed and retained by a collar.

14. The apparatus according to claim 13 wherein said ball bearing extends through an opening in said brace and into a recess in a surface of said base plate.

15. The apparatus according to claim 14 wherein said adjustment rod has an outside diameter that corresponds with an inside diameter of said hollow tube.

16. The apparatus according to claim 15 wherein said hollow tube is provided with a long position opening and a short position opening formed in a surface of said tube.

17. The apparatus according to claim 16 wherein said long position opening and said short position opening are of a diameter sufficient for receiving said spring-loaded pin.

18. The apparatus according to claim 17 wherein said pin can be manually depressed by an individual and selectively moved and released thereby allowing said pin to extend vertically through either said long position opening or said short position opening.

19. The apparatus according to claim 18 wherein said pin is aligned to extend through said long position opening thereby causing said adjustable post mechanism to be set in said long position thereby forming a distance of said hand contact form from said wall in a range of at least 6.25 to about 8.25 inches measured in a horizontal plane.

20. The apparatus according to claim 19 wherein within said ball bearing formed in said adjustment rod permits said adjustable post mechanism to pivot about a vertical and horizontal axis.

21. The apparatus according to claim 19 wherein said ball bearing formed in said adjustment rod permits said adjustable post mechanism to pivot in a manner indicated by an arrow in a horizontal direction where: A=left and B=right.

22. The apparatus according to claim 19 wherein said ball bearing formed in said adjustment rod permits said adjustable post mechanism to pivot in a manner indicated by an arrow in a vertical direction where: X=up and Y=down.

23. The apparatus according to claim 18 wherein said pin is aligned to extend through said short position opening thereby causing said adjustable post mechanism to be set in said short position thereby forming a distance of said hand contact form from said wall in a range of at least 4.25 to not more than 6.25 inches measured in a horizontal plane.

24. The apparatus according to claim 23 wherein within said ball bearing formed in said adjustment rod permits said adjustable post mechanism to pivot about a vertical and horizontal axis.

25. The apparatus according to claim 23 wherein said ball bearing formed in said adjustment rod permits said adjustable post mechanism to pivot in a manner indicated by an arrow in a horizontal direction where: A=left and B=right.

26. The apparatus according to claim 23 wherein said ball bearing formed in said adjustment rod permits said adjustable post mechanism to pivot in a manner indicated by an arrow in a vertical direction where: X=up and Y=down.

27. The apparatus according to claim 3 wherein said hand support apparatus is made of material sufficiently rigid for supporting forces placed thereon without substantial flexing.

28. Hand support apparatus for resting a user's hand above a bathroom commode or urinal comprising:

(a) a base plate adapted to be mounted to a bathroom wall;

(b) a longitudinally adjustable post mechanism pivotally connected at one end to said base plate;

(c) a hand contact form which is fixedly connected to another end of said post mechanism; and (d) a paper towel dispenser mounted adjacent said hand contact form for dispensing a clean supply of paper towels.

29. The apparatus according to claim 28 wherein said hand contact form is in the shape of an open or extended hand and is constructed of a rigid material.

30. The apparatus according to claim 29 wherein said towel dispenser comprises a paper towel pad containing a number of tear-off paper towels shaped in the form of an open or extended hand to match the shape of said hand contact form.

31. The apparatus according to claim 28 wherein said towel dispenser comprises a clean towel supply roller and a used towel take-up roller mounted to entrain a transparent or clear roll of paper towel over said hand contact form and to permit a clean towel to be continuously dispensed from said supply roller to said take-up roller by manually turning knobs formed on the ends of the said supply roller and said take-up roller.

32. Hand support apparatus for resting a user's hand above a bathroom commode or urinal comprising:

(a) a base plate adapted to be mounted to a bathroom wall;

(b) a longitudinally adjustable post mechanism pivotally connected at one end to said base plate;

(c) a hand support bar which is fixedly connected to another end of said post mechanism; and (d) a paper towel dispenser mounted adjacent said hand support bar for dispensing a clean supply of paper towels.

33. The apparatus according to claim 32 wherein said hand support bar is of a generally rectangular shape.

34. The apparatus according to claim 32 wherein paper dispenser includes a pad of tear-off paper tissues of a generally rectangular shape to match the shape of said hand support bar.

35. The apparatus according to claim 34 wherein a front surface of said hand support bar contains an etched hand image and is provided with a Velcro strip and a mating member on said pad of tissues to thereby facilitate replenishing and coupling said pad of paper tissues to said support bar.

* * * * *